US005120242A

United States Patent [19]

Greiler et al.

[11] Patent Number: 5,120,242

[45] Date of Patent: Jun. 9, 1992

[54] SOCKET FOR SINGLE-BASED HIGH-PRESSURE DISCHARGE LAMP

[75] Inventors: Wolfgang Greiler, Unterhaching; Bernd Lewandowski, Munich, both of Fed. Rep. of Germany

[73] Assignee: Patent Treuhand Gesellschaft fur elektrische Gluhlampen m.b.H., Munich, Fed. Rep. of Germany

[21] Appl. No.: 716,848

[22] Filed: Jun. 17, 1991

[30] Foreign Application Priority Data

Jul. 13, 1990 [DE] Fed. Rep. of Germany ... 9010572[U]

[51] Int. Cl.[5] ..... H01R 33/76

[52] U.S. Cl. ..... 439/683; 439/689; 313/51

[58] Field of Search ..... 313/50, 51, 318; 439/605, 611, 612, 617, 619, 683, 689, 699, 558

[56] References Cited

U.S. PATENT DOCUMENTS

| | | | |
|---|---|---|---|
| 4,593,958 | 6/1986 | Baba | 439/558 X |
| 4,741,712 | 5/1988 | Greiler | 439/689 X |
| 4,752,241 | 6/1988 | Matsuoka et al. | 439/918 X |

FOREIGN PATENT DOCUMENTS

| | | |
|---|---|---|
| 8812466 | 12/1988 | Fed. Rep. of Germany . |
| 8812467 | 12/1988 | Fed. Rep. of Germany . |

OTHER PUBLICATIONS

Osram Publication "Metallogen ®-Lampen HMI" (Metallogen ®-Lamps HMI) of Aug. 1990.

*Primary Examiner*—Larry I. Schwartz
*Assistant Examiner*—Khiem Nguyen
*Attorney, Agent, or Firm*—Frishauf, Holtz, Goodman & Woodward

[57] ABSTRACT

To provide for reliable connection of electrical terminal contact elements (5, 5', 5'') within a socket body (2) and remove stresses such as tension, pressure, or torsion applied by a connecting cable (9), the contact terminal elements (5) are formed with a plate-like projection, extending essentially parallel to the contact elements, and secured in grooves or slots (12) formed in the inner walls of the body of the socket, or between projecting ribs (21) extending from the contact terminal chamber walls (7).

15 Claims, 9 Drawing Sheets

SOCKET FOR SINGLE-BASED HIGH-PRESSURE DISCHARGE LAMP

Reference to related publications, assigned to the assignee of the present invention:

German Utility Model Publication No. G 88 12 466.5

German Utility Model Publication No. G 88 12 467.3

OSRAM Publication "METALLOGEN®- Lampen HMI ("METALLOGEN®-Lamps HMI") of August 1990

FIELD OF THE INVENTION.

The present invention relates to a socket for a single-based high-pressure discharge lamp, and more specifically to a socket which is readily adaptable to retain such lamps in fixtures, with or without reflectors, and capable of withstanding high ignition voltages, while being of minimum size.

BACKGROUND

Lamps of the type to which the present invention relates—and as illustrated in FIG. 2A—are known. The lamps themselves have standardized bases, and the sockets must be adapted to fit these standard bases. The known socket is safe with respect to stray electrical fields, spurious discharges, or surface or creep paths.

Basically, the socket is of generally cylindrical construction. Connecting cables lead from the socket, to supply ignition as well as operating energy. The inner structure of the socket is essentially symmetrical and compact. Contacting elements adapted to connect with contacting blades, lugs or pins extending from the lamp element itself are retained within chambers of essentially H shape, so that the contacting elements are surrounded at all sides, open only through suitable openings to receive the connecting blades from the lamp and, at the other end, the cables extending from the socket. The overall combination of the system lamp—lamp base—socket is capable of withstanding high voltage pulses in the order of up to about 20 kV , required for reignition of the lamp when it is still hot.

The socket is assembled without use of rivets or any other metallic attachment parts. This substantially increases the high voltage protection. The contact elements are inserted into the associated chamber, when it is still open, and pre-assembled with the connecting cables which are threaded through a suitable cable opening. The chambers are then closed off by a cover plate or cover plates which, at the same time, locate the contact elements for the connecting blades of the lamp in position. These connecting blades pass through openings formed in the covers, matching the size and shape of the connecting blades or pins. This ensures introduction of the contact elements in appropriate form, and good contact with the connecting elements within the socket itself. The cover plates, as the socket itself, are made of an insulating material, for example ceramic, capable of accepting high temperature. Other materials may also be used. The cover plates are secured to the remainder of the socket structure by adhesives or cements above the chambers.

The cover plate is formed with a recess which fits around a complementary portion of the lamp base, so that an interfitting connection between the lamp base and the socket is ensured. This arrangement, by overlap of socket and the lamp base within the region of the plug connection, further increases the protection against inadvertent touching or engagement of extraneous elements, or of a careless operator, and further increases the path length protecting the electric energy carrying components against arc-over or spurious creep paths. The openings to receive the contact blades or pins extending from the lamp are located within this recess. The cover plates, adhered or cemented to the remainder of the socket, are partially covered by the lamp base, when the lamp is inserted therein, so that even if the adhesion or cementing of the socket should come loose, or have been incompletely cured, the cover plate cannot come loose from the socket, when the lamp is engaged therein. Thus, the electrical integrity and insulation is maintained, even in case of equipment malfunction.

The lamp base is formed with an extended portion which fits into the recess of the socket, to provide a mechanical interfit. This recess is provided with an axially projecting ridge or rib, which fits into a groove formed in the projection of the base, to ensure insertion of the lamp into the socket in a predetermined direction, to maintain the polarity of the lamp terminals. This is important for appropriate application of energy to the lamp, and especially the high voltage ignition pulse.

All constructional elements are located within the interior of the socket, and the socket has no externally accessible assembly joints, bores or the like. The smooth outer contour, with an integral wall, prevents high voltage flares.

The socket is particularly suitable for use with lamps of minimum dimension, that is, for example for lamps used in portable film and television camera and like applications, associated with a reflector and operated for example from battery power supply as used, for example, in live film or television reporting, where daylight-simulated auxiliary light is required. Usually, the lamp fixtures are small and, for portability and association with a camera, have to be light.

It has been found, in actual use, that the bases constructed in accordance with the aforementioned German Utility Model No. G 88 12 466, particularly when associated with hand-held reflectors, cannot accept at all times the mechanical stresses applied against the electrical terminal elements, when the sockets are installed in lamps which are handled carelessly. It has been found that, upon rough and inconsiderate handling of the fixtures, the contact elements within the chambers might tip and cause chatter or shift of the electrical terminal and contact engagement between the contact elements in the sockets and in the lamp base. The lamp socket may be aligned with an optical system, for example a reflector or a lens system, and upon relative shift of the socket and the lamp, adjustment of the lamp with respect to the fixture may change, hence changing the pattern of the light output.

It would be possible to secure the known contact elements within the socket chamber base by a cement. Doing so, however, is expensive and is difficult to carry out in automatic manufacturing machinery.

THE INVENTION

It is an object to improve a socket construction for high-pressure single-based discharge lamps, particularly metal halide discharge lamps, in which a high voltage pulse is utilized to start or re-start the lamp, and in which the electrical terminal elements are so secured within the socket that they are capable of withstanding push, pull or twist stresses, and mishandling, which, further, can be made by mass production processes, and which, additionally, is capable of withstanding the high voltage pulses, which are in the kilovolt range.

Briefly, the metallic connecting or contact elements in the socket, adapted to engage the lamp terminal blades or pins, and the adjacent walls of the socket are formed with interengaging, interfitting projection-and-recess means, for example by attaching a plate-like element to the contact terminal springs which fits into a slot or between ribs formed in the socket walls which define the chamber in which the contact terminal elements are located. Preferably, the interengaging interfitting projection-and-recess means extend essentially axially with respect to the body.

The arrangement substantially improves the socket construction since the expensive and labor-intensive cementing or otherwise attaching the contact terminal elements in the socket body can be avoided. Additionally, the contact elements within the socket body cannot tip or change positions upon transfer of twist or tension stresses from the attached cables. The arrangement is easily so placed that the terminal elements are fitted into the chamber, formed with a base surface which engages the bottom of the chamber, and, in accordance with the invention, has a second engagement region within the chamber which is in addition to the bottom wall, for example the slot or projecting ribs, extending essentially axially, that is, at right angles to the bottom of the chamber. Twisting, turning and other torques which are applied by the connecting cable, upon handling of a fixture in which the socket is secured, and which are transferred to the contact elements themselves, are accepted by the additional interengaging projection-and-recess arrangement, to which the contact elements are coupled, so that the actual contacting regions of the contact elements, that is, where they engage the connecting blades or connecting pins of the lamp, will not be affected by such extraneously induced stresses or torques.

The additional attachment element is, preferably, a small plate secured to or formed on a bottom portion of the contacting element itself, and extending parallel thereto but spaced therefrom, engaging a pair of slots formed in the walls of the chamber, or between a pair of ribs projecting from the chamber wall. These plate-like extensions can be slightly bent, or be formed with an uneven or slightly undulating or ruffled surface, to additionally obtain a clamping effect with respect to the wall of the reception slot, or the ribs, respectively. Preferably, the thickness of the slot, or spacing between the ribs, is suitably matched to the thickness of the plate-like element, e.g. to permit a cement filler to enter.

The arrangement has the additional advantage that the slots, when open to the top part of the socket before the cover plates are attached, will be filled with adhesive or cement as the cover plates are adhered or cemented to the top of the socket, to thereby obtain excellent positioning and maintenance of the position of the contact element within the chamber without, however, requiring a specific cementing or adhering step of the contacting portion as such of the element.

In use, it has been found that the socket is excellently resistant against high voltage pulses and electrical stresses, since no metallic attachment elements, such as rivets or screws, are used. Each one of the electrical contact elements is located in a separate chamber, which is closed, except for access openings for electrical cables and the contact blades or contact pins of the lamp. The socket can be secured in suitable fixtures and is formed with openings for their attachment. The attachment of the socket to the fixture, which may include optical elements, can be done with attachment elements of insulating material; the socket can be so designed that openings for attachment screws are suitably spaced from the electrical energy carrying contacts to prevent spurious arc-over, even if metallic attachment elements of the socket to a fixture are used.

DRAWINGS

Figure 2:
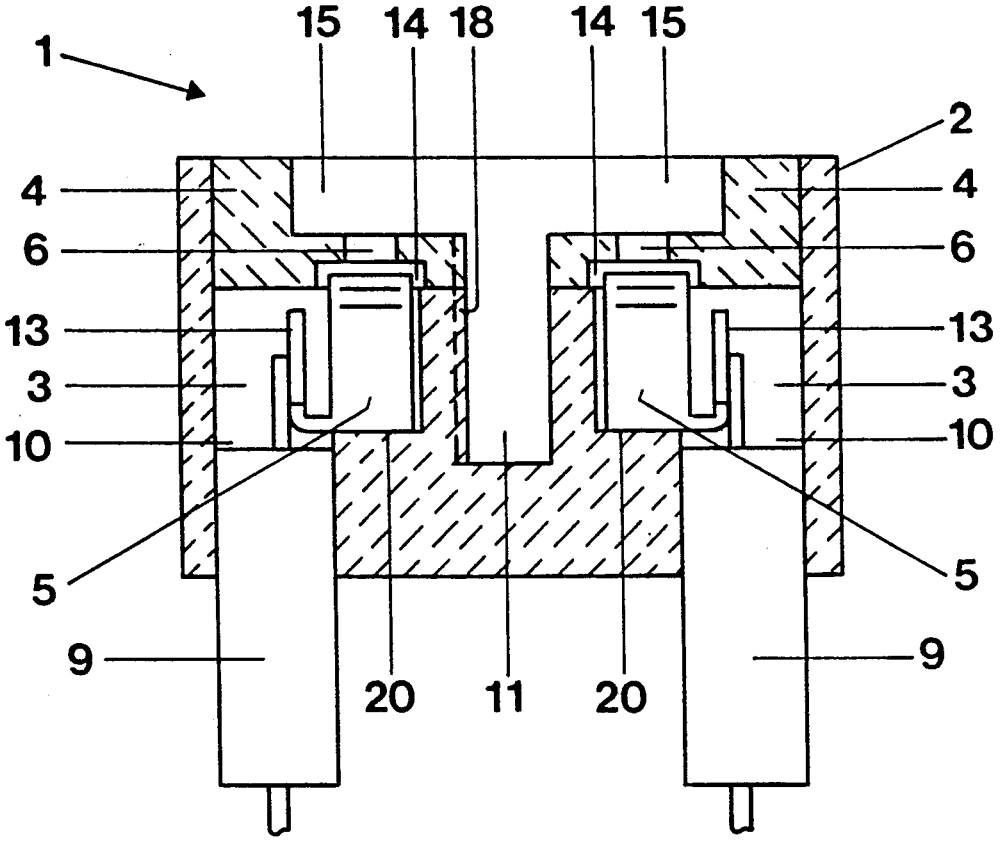
FIG. 2 is a longitudinal sectional view through FIG. 1 along the line II—II, in a plane perpendicular to the plane of the drawing of FIG. 1, in which two contact terminal elements are shown.
Figure 2A:
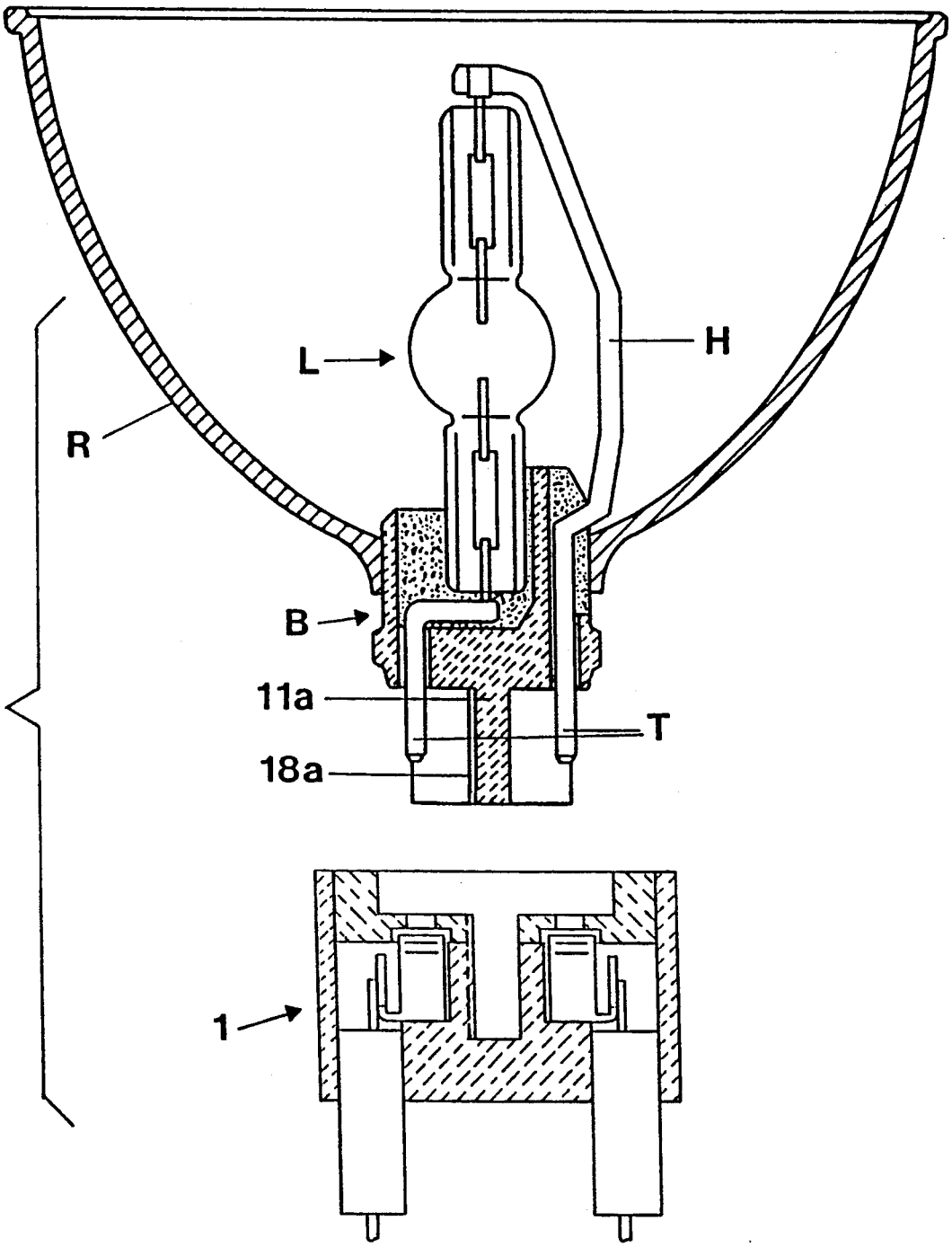
Figure 3A:
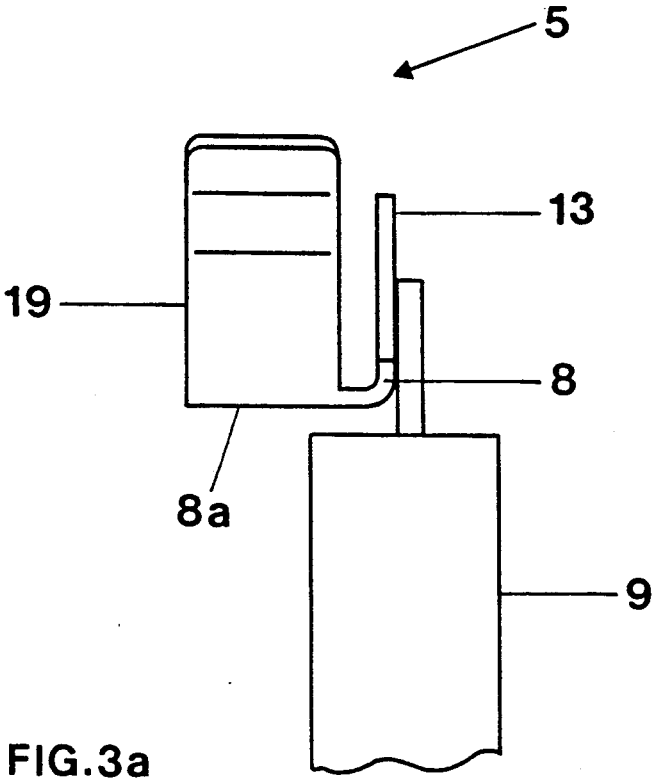
Figure 3B:
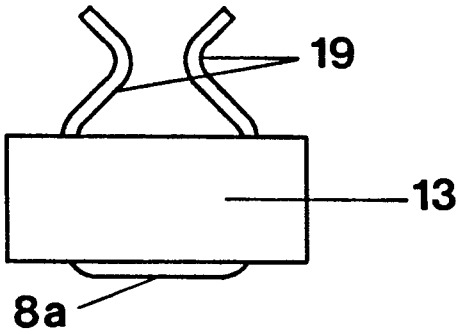
Figure 3C:
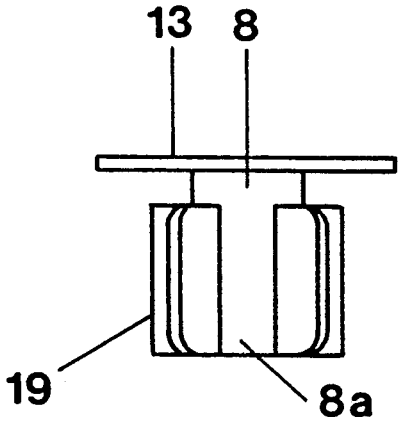
Figure 4:
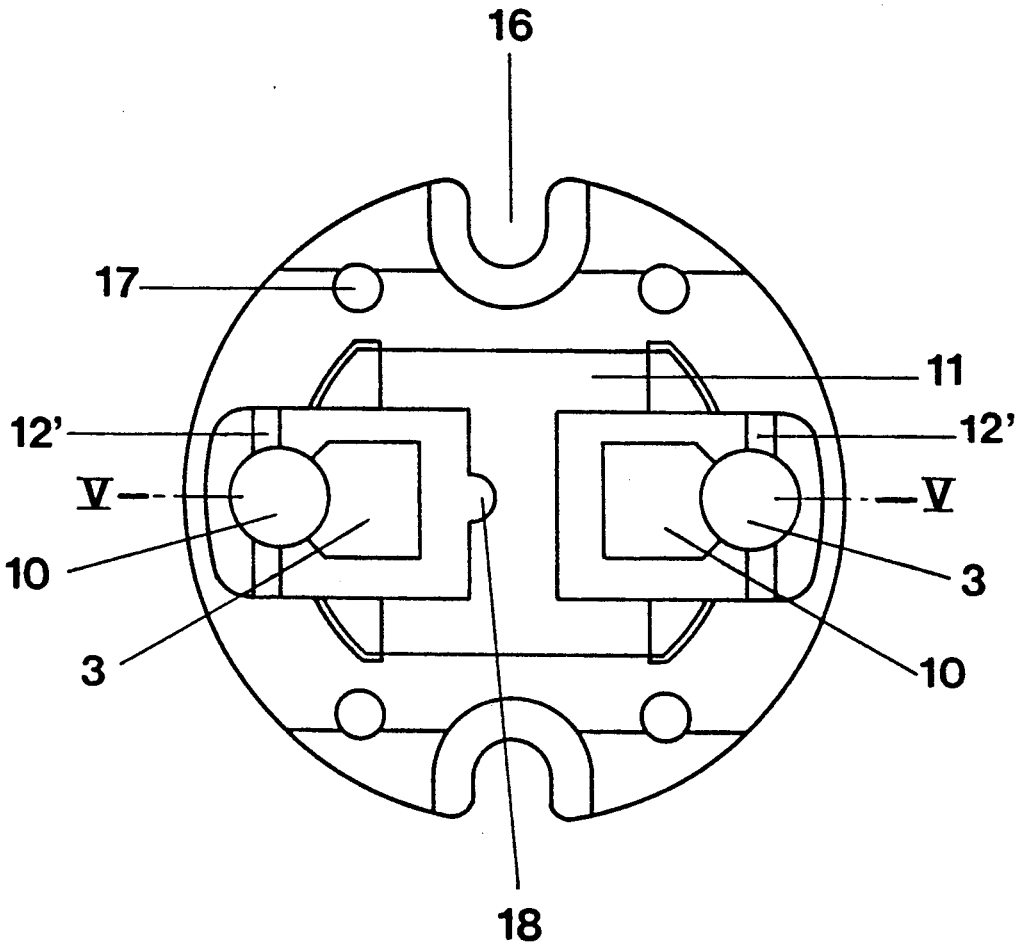
Figure 5:
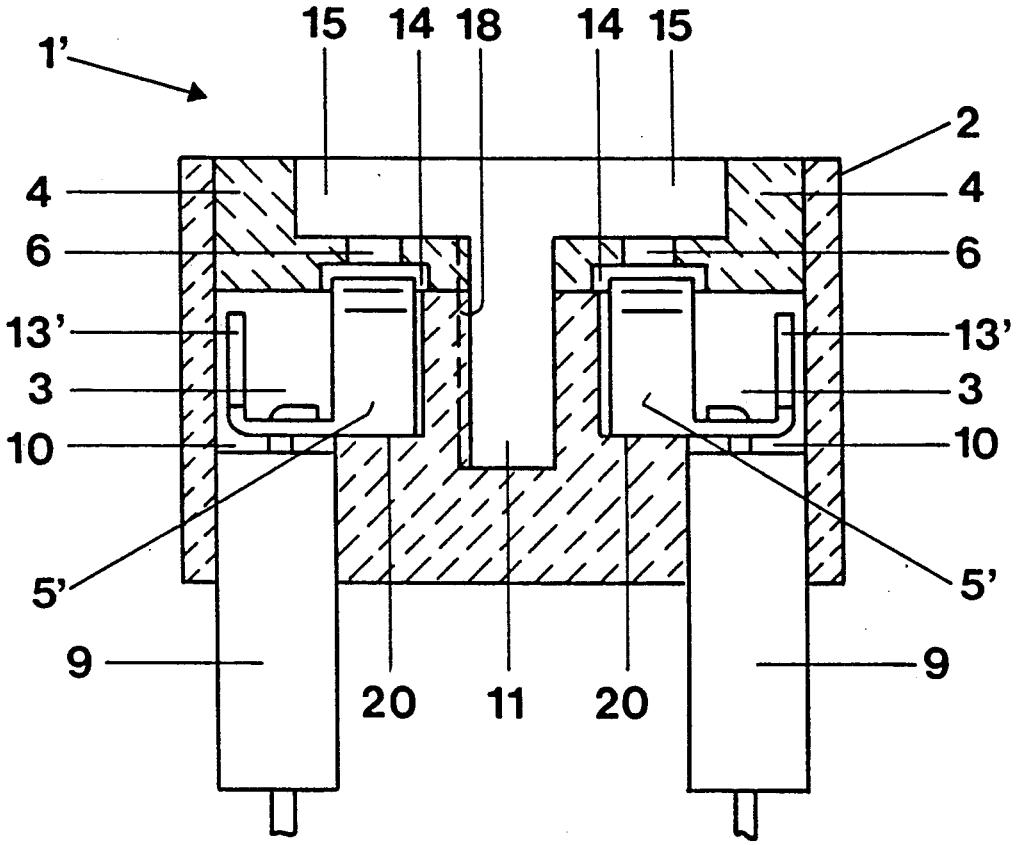
Figure 6A:
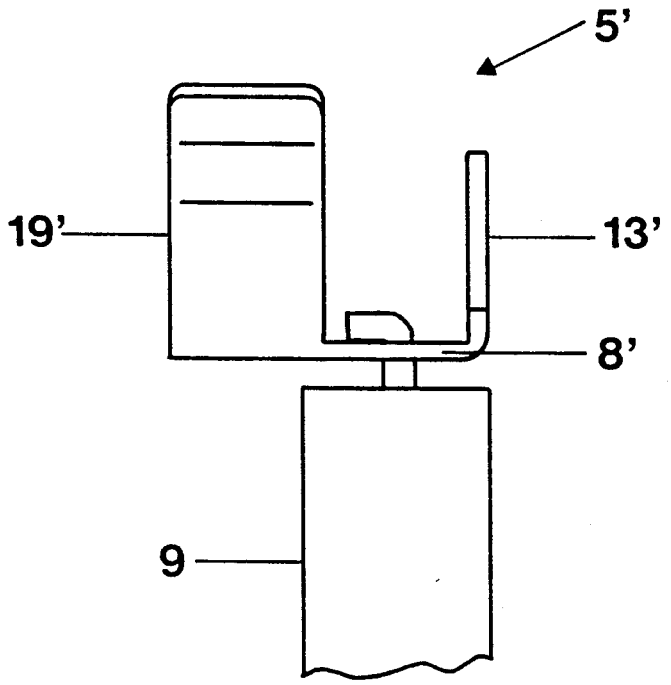
Figure 6B:
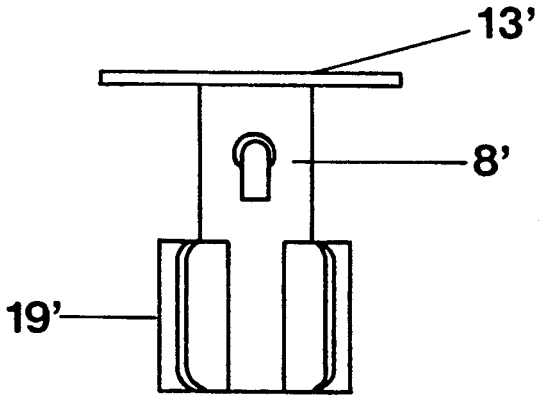
Figure 7:
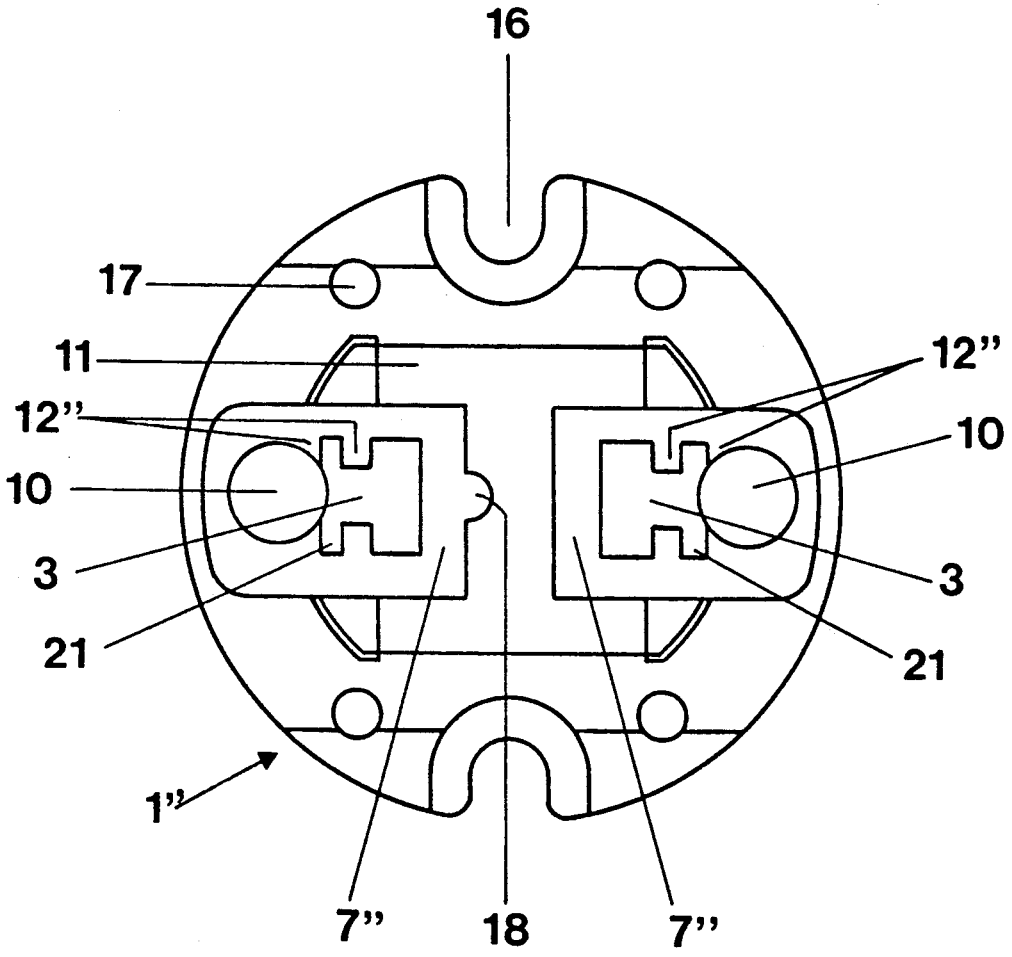
Figure 8A:
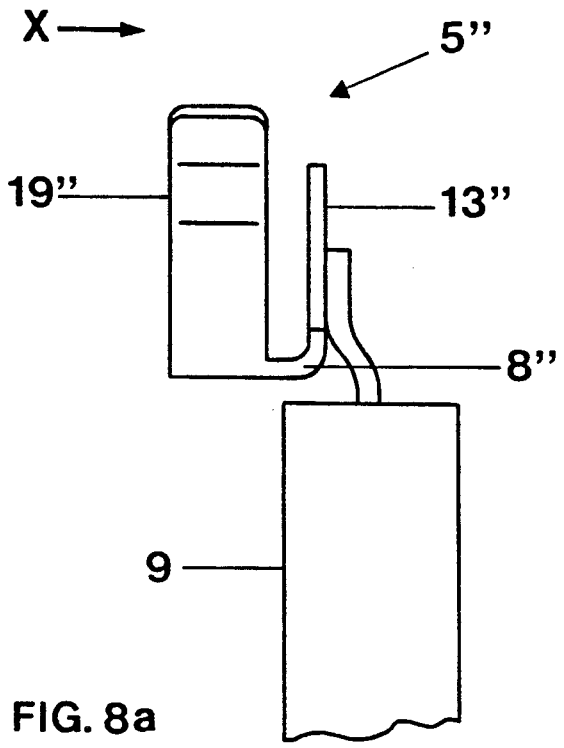
Figure 8B:
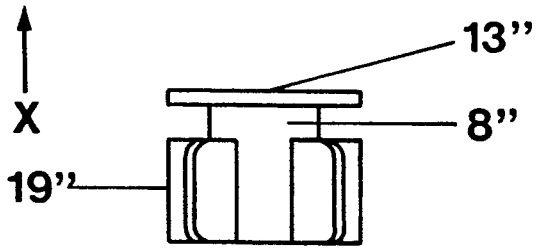

FIG. 2*a* is an exploded highly schematic view of the socket of FIG. 2 in combination with a reflector-type metal halide high-pressure lamp;

FIG. 3*a* is a side view of a contact terminal element with a connecting cable secured thereto;

FIG. 3*b* is a front view of the element of FIG. 3*a*, without the attached cable;

FIG. 3*c* is a top view of the element of FIG. 3*a*, without the cable;

FIG. 4 is a top view of another embodiment of a socket;

FIG. 5 is a view similar to FIG. 2, along line V—V of FIG. 4;

FIG. 6*a* is a side view of a terminal for use in the socket of FIG. 4;

FIG. 6*b* is a top view of the terminal for use in the socket of FIG. 4;

FIG. 7 is a top view of another embodiment of the socket;

FIG. 8*a* is a side view of the electrical terminal element for the socket of FIG. 7; and FIG. 8*b* is a top view of the contact element of FIG. 8*a*.

The figures in the drawings are not drawn to scale, but distorted, where necessary, for better visibility.

DETAILED DESCRIPTION

Referring first to FIG. 2*a*:

A single-based high-pressure metal halide discharge lamp L is secured in a base B. A reflector R can be secured to the base B; the reflector R need not be secured to the base B, however, but may be part of a lamp fixture in which the socket 1 is to be inserted. The reflector, usually, is part of the fixture with which the lamp is to be used, and may differ substantially from that shown, in dependence on the design by the fixture manufacturer. This is particularly so with respect to the placement of the neck of the reflector R on the base B; it need not even be secured to the base B. The lamp L, however, must be associated optically with the reflector R and, therefore, be coaxial therewith and have a predetermined position with respect to the focal point of the reflector and/or a lens system closing off the lamp fixture in which the reflector R and the lamp are to be installed.

The lamp L can be a standard metal halide discharge lamp, for example of the type commercially known as OSRAM Metallogen® HMI® lamp type HMI 123, having a rated power of 125 W and suitable, for example, for use as a light source in connection with portable film and video recording apparatus. The particular socket construction may be used with lamps and bases of other types, of course.

Electrical energy is supplied to the lamp L over two flattened terminal blades T, which are led out of the base B. The base is formed with a locating projection 11*a*, which fits into a recess 11 of the socket. The projection 11*a* is formed with a groove 18*a*, into which a locating projection 18 of the socket fits.

Figure 1:
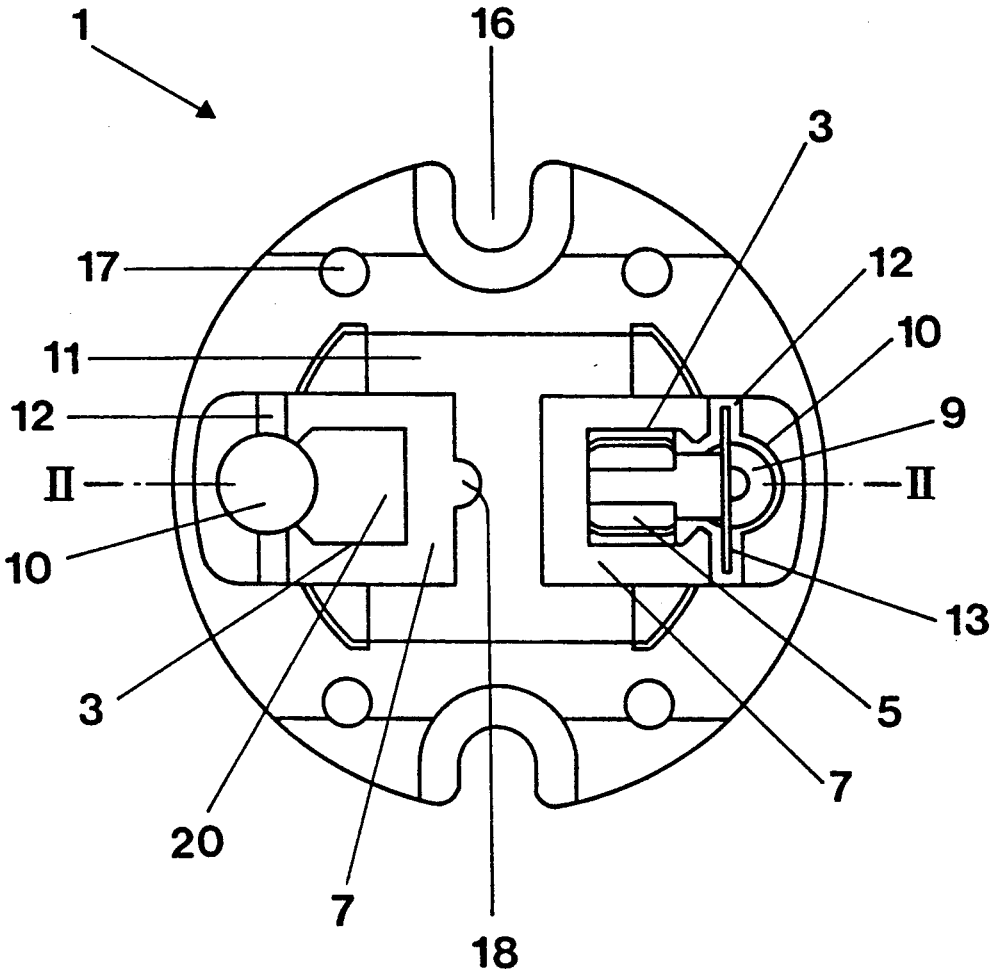
FIG. 1 is a top view of the socket in which one terminal element, at the left side, has been omitted, for clarity of illustration.

Referring next to FIGS. 1 and 2

The socket 1 has an essentially cylindrical socket body 2 made of ceramic material. It is formed with two axially extending grooves 16 and axial bores 17 to attach the socket 1 in a suitable fixture. The socket is formed with two oppositely positioned chambers 3 having wall elements 7 (FIG. 1), which are separated by an H-shaped recess 11. Each one of the two chambers 3 is fitted into a half of the H-shaped recess 11, so that the chambers 3 are surrounded from three sides by the recess 11, to receive the lamp base B. The socket body 2 has recesses in various planes, which are shown by their outline in FIG. 1. The lowest visible plane is formed by the bottom of the H-shaped recess 11. The next higher plane—with reference to FIG. 1—is defined by the bottom 20 of the chamber 3, see FIG. 2. Through-bores 10 are formed in the bottom 20 to provide openings for connecting cables 9 of an energy supply source. The walls 7 of the chambers 3 define a region above the bottom wall 20. The highest level of the body 2 is the plane surface in which the bores 17 are formed.

Connecting or contact elements 5 are located in the chambers 3, to which the electrical lead or wire of the cable 9 is secured, for example by welding. The electrical contact or terminal elements 5 have a U-shaped metallic portion defining two legs 19 (see FIGS. 3*a*, 3*b*, 3*c*). The free ends are inwardly offset to provide for a snap-in and positive engagement spring connection for the contact blades or contact pins T of the lamp L. The two legs 19 are connected together at the bottom by a bottom region 8*a*.

In accordance with the present invention, the terminal or contact elements 5 are positively secured in the respective chambers 3, by having secured thereto a receiving holding element 13, essentially in plate form—see FIG. 1, contact element at the right side of the socket, and FIGS. 3*a*–3*c*. The elements 13 position the socket contacts 5 in the socket body 2. The plate elements 13 are secured within the chambers 3 by being fitted into interengaging reception slots 12. In the embodiment of FIG. 1, the slots 12 are so positioned that a central line therethrough intersects the center of opening 10 for the cable 9, see FIG. 1. The slots 12 extend to almost the bottom 20 of the chamber 3. In the left side of FIG. 1, the electrical contact elements 5 with the associated cable 9 has been omitted; it is shown at the right side only. In actual use of course, contact elements 5 will be placed in both chambers. The holding plate 13 engages into the respective slots 12 wit its end portions, and thereby anchors contact or terminal elements 5. The width of the holding plate 13 is slightly greater than the width of the chamber 3; the thickness of the element 13 is dimensioned to fit snugly or initially loosely within the slot 12. It is shown at the right side of FIG. 1 highly schematically and reduced, for better visibility, although in actual practice it may have practically the same thickness as the width of the slot 12. It can be made narrower, however, in which case, in accordance with a feature of the invention, the plate element 13 can be slightly undulated so as to engage the side walls of the slots 12.

The electrical contact elements 5 are formed with a connecting flap 8 extending from the connecting or bottom region 8*a* of the generally U-shaped terminal elements, and bent upwardly, and extended laterally to form the plate element, as best seen when considering FIGS. 3*a* and 3*b*. The connecting portion 8, which can be integral with the leg portions 19, is connected to the metallic lead of the cable 9, for example by resistance-welding the cable 9 to the plate element portion 13.

The terminal elements 5 are so located in the chambers 3 that the bottom connecting portion 8*a* as well as the immediately adjacent region of the extending portion 8 engages the bottom wall 20 of the chambers 3. The plate element 13 then fits in the corresponding holding slot 12, as described in connection with FIG. 1.

The chambers 3 are each closed off at the top by a cover 4, which may consist of more than one plate element, but which, preferably, is a unitary structure. The cover 4 is secured to the socket body 2 by a suitable cement. The cement, originally flowing, fills any free spaces in the slots 12 with holding cement so that, upon curing of the holding cement, the plates 13 of the electrical terminal elements 5 are completely and reliably and securely positioned within the chambers 3. If sufficient cement is used, the plate element 13 may be narrower than the slots 12, as shown in FIG. 1, and suitably dimensioned to receive the holding cement. The cover or covers 4, at the inside thereof and facing the chambers 3, are formed with recesses 14, dimensioned and shaped to receive the free ends of the legs 19 of the terminals 5. At the side of the covers 4, which is remote from the chambers 3, the covers 4 are formed with a recess 15, which is shaped and dimensioned to receive the bottom portion of the base B of the lamp. The recesses 14, 15 are connected by respective openings 6, dimensioned and shaped to receive a contact element , such as a contact blade, pin, or flattened pin T extending from the base B of the lamp so that an electrical connection can be made between the contact elements T of the lamp and the contact terminal elements 5 in the socket 1.

The socket body 2 is formed with a radially inwardly projecting positioning rib 18, extending within the H-shaped recess 11, and fitting into the groove 18 formed in the projection 11*a* of the base B of the lamp, in order to ensure proper polarity of insertion of the lamp into the socket. This is important in order to apply the high-voltage pulse always at the short current supply lead to the lamp, that is, with respect to FIG. 2*a*, at the left current supply lead, but not over the holding lead H of the lamp which connects with the upper electrode thereof and which should be grounded. FIGS. 4–6: The socket 1' is basically identical to the socket 1 of FIGS. 1–3; the difference is that the slots 12'—see FIG. 4—are moved further radially outwardly with respect to the slots 12 of FIG. 1. The electrical terminal elements 5' are formed with a radially outwardly extended projecting portion 8', moved further outwardly from the leg portions 19', see FIGS. 6*a*, 6*b*, so that the positioning plate element 13') is also further away from the leg portions 19'. The electrical lead of the cable 9 is passed through a small opening in the projecting portion 8', bent over at a right angle, and welded to the projecting portion 8'.

Embodiment illustrated in FIGS. 7 and 8

The difference between the embodiments of FIGS. 1–3 and 4–6 is that the walls 7″ of the chambers are formed with projecting ribs 12″, extending into the interior space of the chambers 3 and, between the ribs 12″, form slot regions 21 for the holding plate elements 13″ of the electrical terminal contacts 5″. Each one of the slots 21, thus, is defined by two adjacent ribs 12″ on the same wall 7″. The chambers 3 are mirror-symmetrical, each chamber wall having the appropriate ribs 12″.

The contact elements for use with these chambers are designed to fit therein, and they can be highly compact. The U-shaped projecting portion 8″ is very short, that is, the extension of the portion 8″ in the direction X in FIGS. 8*a*, 8*b* is small. The width of the holding plate element 13″ is only wide enough to span the width of the chamber 3. The end of the cable 9 is welded to the plate element 13″ and, since the projection 8″ is so short, the cable is slightly bent, as best seen in FIG. 8*a*. The slots 21 formed by the ribs 12″ for the plate 13″ are not located above the bores 10 for the cable 9 but, rather, are placed closer to the center line of symmetry of the socket 1″, requiring the bend in the connecting lead of the cable 9 as seen in FIG. 8*a*.

The interengaging arrangement of the slots 12, 12′, 12″ with the plate elements 13, 13′, 13″, ensures reliable sturdy retention of the terminal contact elements 5, 5′, 5″ within the socket body 2, regardless of stresses in tension, twist, or torsion applied on the cables 9, and transferred to the contact elements 5. The transfer is indirect, namely to the plate element 13 which is secured within the socket body in the interengaging projection and recess fit, so that the electrical connection between the contact elements 5 and the terminal lugs or blades or pins T of the lamp is not affected by stresses placed on the cable 9.

Various changes and modifications may be made, and any features described herein may be used with any of the others, within the scope of the inventive concept.

We claim:

1. A socket for a single-based high-pressure discharge lamp and capable of withstanding high voltages in the kilovolt range, said lamp having a base (B) and terminal elements (T) projecting therefrom, said socket having a socket body (2) of heat-resistant, electrically insulating material, said body being formed with a recess (11) to receive the base (B) of the discharge lamp (L), said body further being formed with two separate chambers (3);

an electrical contact terminal element (5, 5′, 5″) located in each of the chambers;

external current supply means (9) coupled to said terminal elements (5, 5′, 5″);

a cover plate (4) for each of the chambers, said cover plate being formed with at least one opening therein to permit entry of the terminal element (T) of the lamp into the respective chamber covered by the cover plate;

passage means (10) extending from each of the chambers outwardly of the socket body (2) for passage of a connection cable (9) through each one of said passage means, and comprising means for isolating mechanical stresses transferred between the external current supply means (9) and the terminal elements, said isolating means including interengaging, interfitting projection (13, 13′, 13″) and recess (12, 12′, 12″) means formed, respectively, on said contact elements (5, 5′, 5″) and the walls (7) defining said chambers, which interengaging, interfitting projection-and-recess means include a plate-like element (13, 13′, 13″) formed on each contact terminal element and positioned essentially parallel to the axis of said body (2); and two grooves or slots (12, 12′, 12″) extending essentially parallel to the axis of the body in the walls (7, 7′, 7″) defining the chamber and shaped and dimensioned such that said plate-like elements fit into the grooves or slots.

2. The socket of claim 1, wherein said walls of the chamber are essentially flat and wherein said two grooves are depressed from and extend into the walls (7) of the chamber.

3. The socket of claim 1, wherein said walls (7) of the chamber are formed with two spaced inwardly projecting rib means (21), and said grooves or slots (12*a*) are formed by the wall surface between said rib means.

4. The socket of claim 1, wherein said terminal contact elements (5, 5′, 5″) are formed with a laterally projecting portion (8, 8′, 8″) on which said plate-like elements are formed.

5. The socket of claim 1, wherein said external current supply means comprises a connection cable (9); and wherein said connection cable (9) is welded to the plate-like elements (13, 13′, 13″).

6. The socket of claim 1, wherein said external current supply means comprises a connection cable (9); and wherein said connection cable (9) is welded to the projecting portion (8′) extending from the terminal contact element.

7. The socket of claim 1, wherein said plate-like elements (13, 13′, 13″) have a thickness fitting loosely in said grooves;

and wherein said cover plate (4) and said body (2) are secured by an initially flowable, hardenable or curable cement, said initially flowable cement also penetrating into said recess means and retaining said plate-like elements therein upon hardening or curing of the cement.

8. The socket of claim 1, wherein said grooves (12, 12′, 12″) are dimensioned and shaped to receive end regions of said plate-like elements.

9. The socket of claim 1, wherein said chambers (3) define bottom walls (20); and wherein said terminal contact elements (5, 5′, 5″) are seated on said bottom walls.

10. The socket of claim 1, wherein said terminal contact elements comprise spring elements bent into essentially U shape defining two upstanding legs (19) and a connecting portion (8*a*), said upstanding legs being adapted to grip said terminal elements (T) projecting from the base (B) of the lamp;

a projecting portion (8), unitary with said connecting portion, projecting laterally from said connecting portion (8*a*) and terminating in said laterally extending plate portions (13), said laterally extending plate portions being bent to lie adjacent, but spaced from, said upstanding leg portions, and wherein said external current supply means comprises a connection cable (9), secured to at least one of:

said projecting portion (8);

said laterally extending plate portion (13), whereby stresses placed on said connection cable can be absorbed by the interengaging, interfitting projection-and-recess means and separated from said upstanding legs (19) of the terminal contact element (5, 5', 5'').

11. The socket of claim 10, wherein said walls of the chamber are essentially flat and wherein said two grooves are depressed from and extending into the walls (7) of the chamber.

12. The socket of claim 10, wherein said walls (7) of the chamber are formed with two spaced inwardly projecting rib means (21), and said grooves or slots (**12*a***) are formed by the wall surface between said rib means.

13. The socket of claim 10, wherein said plate-like elements (13, 13', 13'') have a thickness fitting loosely in said grooves;

and wherein said cover plate (4) and said body (2) are secured by an initially flowable, hardenable or curable cement, said initially flowable cement also penetrating into said recess means and retaining said plate-like elements therein upon hardening or curing of the cement.

14. The socket of claim 1, wherein the socket body (2) is of ceramic material.

15. The socket of claim 10, wherein the socket body (2) is of ceramic material.

* * * * *